US006402076B1

(12) United States Patent
Werner

(10) Patent No.: US 6,402,076 B1
(45) Date of Patent: Jun. 11, 2002

(54) METHOD OF CONTROLLING SPEED AND ROTATION COUNTS OF A SPINDLE OF AN EXACT SHEET-COUNT METERED WINDER

(75) Inventor: Peter Harold Werner, West Bend, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/547,586

(22) Filed: Apr. 12, 2000

(51) Int. Cl.[7] ..... B65H 23/198

(52) U.S. Cl. ..... 242/413.1; 242/413.2; 242/413.9

(58) Field of Search ..... 242/413.1, 413.2, 242/413.9, 534, 534.2, 523.1; 700/126

(56) References Cited

U.S. PATENT DOCUMENTS 3,348,107 A * 10/1967 Hamby ..... 242/413.9
3,372,320 A * 3/1968 Boyum et al. ..... 242/413.9
3,734,423 A 5/1973 Kataoka
4,280,081 A * 7/1981 Dinger et al. ..... 242/413.9
4,438,889 A * 3/1984 Schonmeier ..... 242/413.1
4,519,039 A * 5/1985 Surana et al. ..... 242/413.9
4,535,950 A * 8/1985 Lisnyansky ..... 242/413.1
4,631,682 A * 12/1986 Ng et al. ..... 242/534.2
4,811,915 A 3/1989 Smith
5,154,367 A 10/1992 Beisswanger
5,938,142 A 8/1999 Halperin

* cited by examiner

*Primary Examiner*—John M. Jillions
(74) *Attorney, Agent, or Firm*—Himanshu S. Amin; Alexander M. Gerasimow; William R. Walburn

(57) ABSTRACT

A system and method is provided for developing speed and rotation count profiles for controlling the spindle drive on a towel winder system for winding rolls of paper, such as tissue or towel. The system and method monitors accumulated paper sheet length metered onto the winding spindle to control desired sheet count and finished roll dimension data. The system and method utilizes the accumulated paper sheet length and the desired finished roll data to calculate an instantaneous diameter. The instantaneous diameter calculation includes determining an effective thickness of the roll based on two forms of calculating finished roll cross-sectional area. The system and method also includes monitoring the actual line surface speed. The instantaneous diameter and the actual line surface speed are used to generate a speed reference signal and an inertia compensation signal. An outer compensation loop can be employed to trim the speed reference signal so that the revolution count can be controlled.

31 Claims, 8 Drawing Sheets

METHOD OF CONTROLLING SPEED AND ROTATION COUNTS OF A SPINDLE OF AN EXACT SHEET-COUNT METERED WINDER

TECHNICAL FIELD

The present invention relates to towel winder systems, and more particularly to a system and method for controlling the outside diameter and sheet count of a towel roll during the winding operation.

BACKGROUND OF THE INVENTION

Automated towel winder systems are used to wind rolls of paper, such as paper towels and toilet tissue. These systems roll and perforate thousands of sheets of paper every few minutes. A towel winder system may wind 10–15 rolls of paper concurrently. Typically, a spindle driven by a spindle drive rotating at a predetermined speed profile is employed to wind a roll of paper on a core, until the roll reaches a predetermined outside diameter. It is desired that each completed roll have a predetermined reliable outside diameter and an exact sheet count of paper. However, obtaining reliable outside diameters and exact sheet counts is a highly complex process. It is important to achieve roll uniformity for packaging and shipping in addition to producing rolls at consistent cost. For example, a harder roll having the same diameter as a softer roll means that the harder roll has more paper. Inconsistencies among rolls for a given lot result in non-uniformity in costs and quality not to mention packaging and shipping problems. Therefore, a goal in producing paper rolls is to be able to achieve a uniform sheet count and roll diameter for a batch of rolls.

In the past, efforts to achieve exact sheet count among rolls often involved utilizing machined mechanical cams having linkages to electrical potentiometers or to outer mechanical positioners coupled to electrical signal transducers to produce spindle speed profiles. The spindle speed profiles were used to reduce speed of a rotating spindle on which paper was rolled during winding thereof as the outside diameter of the roll increased. Through a combination of volume and experience a speed reference was measured and these results were used to machine different cams for various desired roll parameters. Pre-selected cams could then be mounted to the machine to produce a speed profile for a particular production run. Over the years, theoretical and empirical information embedded in the cams and electrical signals produced by the cams were used to establish look up tables-this was accomplished by plotting many points on the cam that reflect electrical signals. This hard cam data was then employed to produce a programmed software speed profile referred to as a soft cam. However, both the soft cams and the mechanical cams have a limited number of profile points resulting in inconsistencies from roll to roll. Additionally, the speed profiles are based on information formulated from previously wound rolls and not the lot currently being produced, which may experience slightly different environmental conditions.

Accordingly, there is a strong need in the art for a system and method that provides improvements over conventional techniques for winding rolls to achieve a desired diameter and sheet count.

SUMMARY OF THE INVENTION

The present invention relates to a system and method for developing speed and rotation count profiles for controlling the spindle drive on a towel winder system for winding rolls of paper, such as tissue or towel. The system and method monitors accumulated paper sheet length metered onto the winding spindle to control desired sheet count and finished roll dimension data. The system and method utilizes accumulated paper sheet length data and desired finished roll data to calculate an instantaneous diameter. The instantaneous diameter calculation includes determining an effective thickness of the roll (e.g., sheet thickness and entrapped air) based on two forms of calculating finished roll cross-sectional area. The system and method also includes monitoring the actual line surface speed. The instantaneous diameter and actual line surface speed are used to generate a speed reference signal and an inertia control signal. An outer control loop can be employed to trim the speed reference signal so as to improve controlling revolution count.

In one aspect of the invention, a method is provided for controlling a spindle drive during winding of a towel roll on a towel winder system. The method comprises the steps of monitoring at least one real time parameter relating to winding of the towel roll and determining a speed spindle component that adjusts the spindle drive speed based on changes of the at least one real time parameter.

In accordance with another aspect of the invention, a method is provided for developing a speed profile for a spindle drive during winding of a towel roll on a towel winder system. The method comprises the steps of evaluating an effective thickness of the towel roll, monitoring an accumulated towel length during winding of the towel roll, determining an instantaneous diameter of the towel roll based on the effective thickness of the roll and the accumulated towel length, and determining a spindle speed component that adjusts speed of the spindle drive based on changes in the instantaneous diameter.

In accordance with yet another aspect of the invention, a system is provided for controlling a spindle drive during winding of a towel roll on a towel winder system. The system includes an instantaneous diameter component adapted to monitor accumulated towel length and generate an instantaneous diameter value, and a spindle speed component adapted to receive an instantaneous diameter value from the instantaneous diameter component and generate a spindle speed reference value.

Another aspect of the invention relates to a system for controlling a spindle drive during winding of a towel roll on a towel winder system. The system comprises a processor, a memory operatively coupled to the processor and at least one sensor operatively coupled to the processor, the at least one sensor adapted to monitor a real time parameter relating to winding of the towel roll, wherein the processor receives digital data relating to the real time parameter and generates a spindle speed reference value.

In accordance with an alternate aspect of the invention, a system is provided for controlling a spindle drive during winding of a towel roll on a towel winder system. The system comprises means for monitoring at least one real time parameter relating to winding of the towel roll and means for determining a speed spindle component for adjusting spindle drive speed based on changes of the at least one real time parameter.

In accordance with yet another aspect of the invention, a tool is provided for determining speed values for a spindle drive used in winding of a towel roll on a towel winder system. The tool comprises a towel winder data spread sheet that allows for modification of basic product set up data. The towel winder data spread sheet is adapted to calculate a total length on a finished roll and an effective thickness of individual wraps. The towel winding data spread sheet is further adapted to calculate spindle speed based on entered machine speed. The towel winding data spread sheet is also adapted to calculate length of towel on a roll, the diameter of the roll and mandrel revolutions of the roll based upon number of sheets per roll.

To the accomplishment of the foregoing and related ends, the invention then, comprises the features hereinafter fully described and particularly pointed out in the claims. The following description and the annexed drawings set forth in detail certain illustrative aspects of the invention. These aspects are indicative, however, of but a few of the various ways in which the principles of the invention may be employed and the present invention is intended to include all such aspects and their equivalents. Other aspects, advantages and novel features of the invention will become apparent from the following detailed description of the invention when considered in conjunction with the drawings.

DETAILED DESCRIPTION OF THE INVENTION

Figure 1:
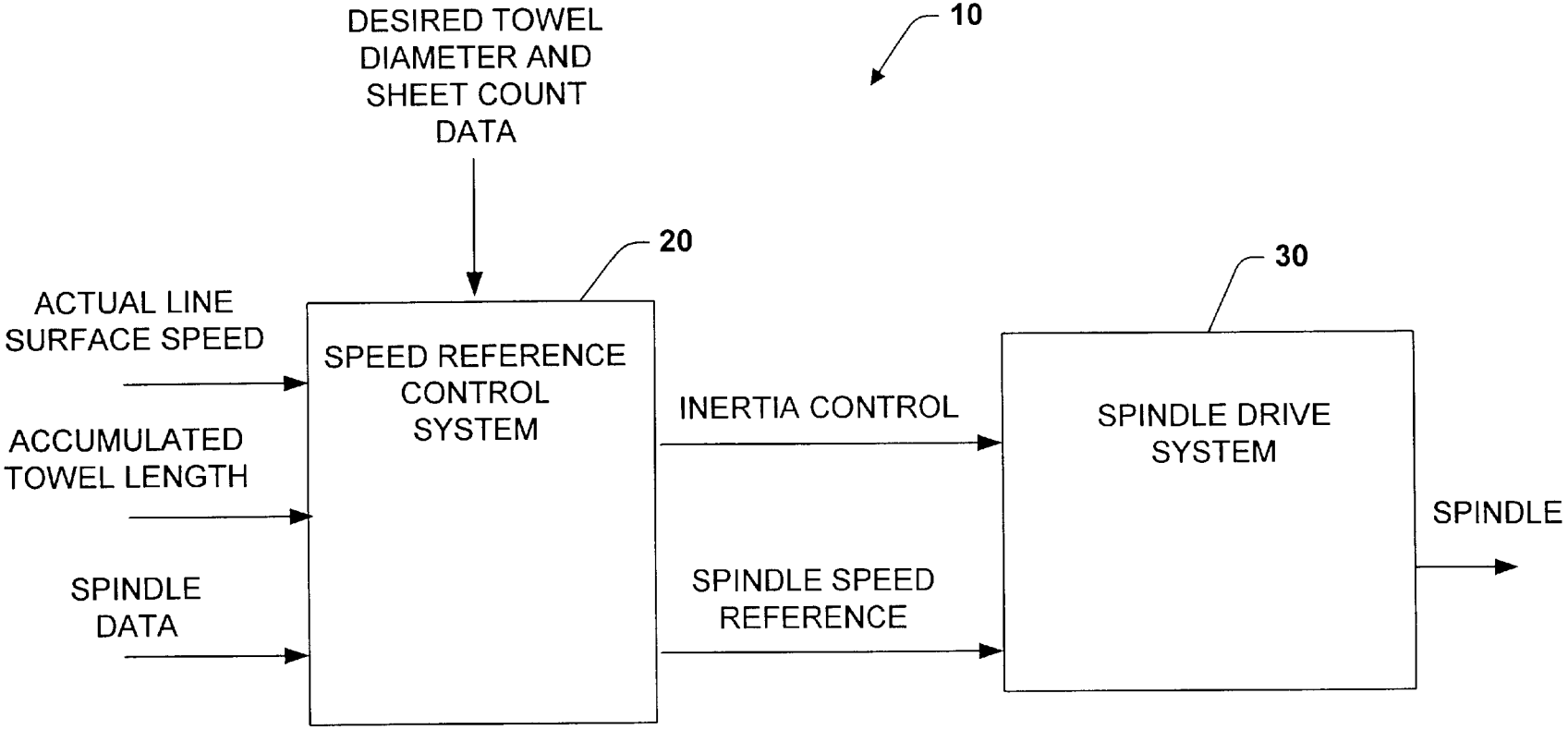
FIG. 1 illustrates a block diagram of a speed control system coupled to a spindle drive system in accordance with one aspect of the present invention.

The present invention is now described with reference to the drawings, wherein like reference numerals are used to refer to like elements throughout. The present invention is described with reference to a system and method for controlling speed of a spindle on a towel winder according to a speed profile based on progressive calculations. It is to be appreciated that the control system of the present invention may be implemented as a continuous, semi-continuous, and/or discrete control system. The system and method utilizes information about a desired roll diameter and sheet count in performing these calculations. Additionally, the system and method monitors certain real time parameters of a towel roll during the winding process and makes progressive adjustments accordingly. It is to be appreciated that these progressive calculations and adjustments can be performed via software, hardware or a combination of software and hardware.

FIG. 1 illustrates a system 10 including a speed reference control system 20 coupled to a spindle drive system 30. The speed reference control system 20 monitors actual line surface speed of a towel winder system and actual accumulated towel length received by the roll. The speed reference control system 20 is also adapted to receive desired towel diameter and sheet count data. The speed reference control system 20 utilizes this information to produce a spindle speed reference signal for reducing the speed of the spindle. The speed reference control system 20 can also produce a speed derivative of the speed reference signal to provide for inertia control necessitated due to change in mass of the roll and change in speed of the spindle. The speed reference control system 20 can also receive spindle data, which may include monitoring an encoder coupled to the spindle, and data relating to the encoder. This allows the speed reference control system 20 to monitor the number of revolutions of the spindle and provide an outer position control loop to make available a velocity trim control signal to a feed forward spindle speed reference. The spindle speed reference signal and the inertia control signal are transmitted to the spindle drive system 30. The spindle drive system 30 controls spindle speed in revolutions per minute (rpm). The speed reference control system 20 receives actual line surface speed and accumulated towel length to provide a spindle speed profile based on real time data and an N number of data points (N being an integer). Actual line surface speed is developed as reference data in the system driving the towel. Alternatively, the actual line surface speed can be monitored employing a sensor.

Figure 2:
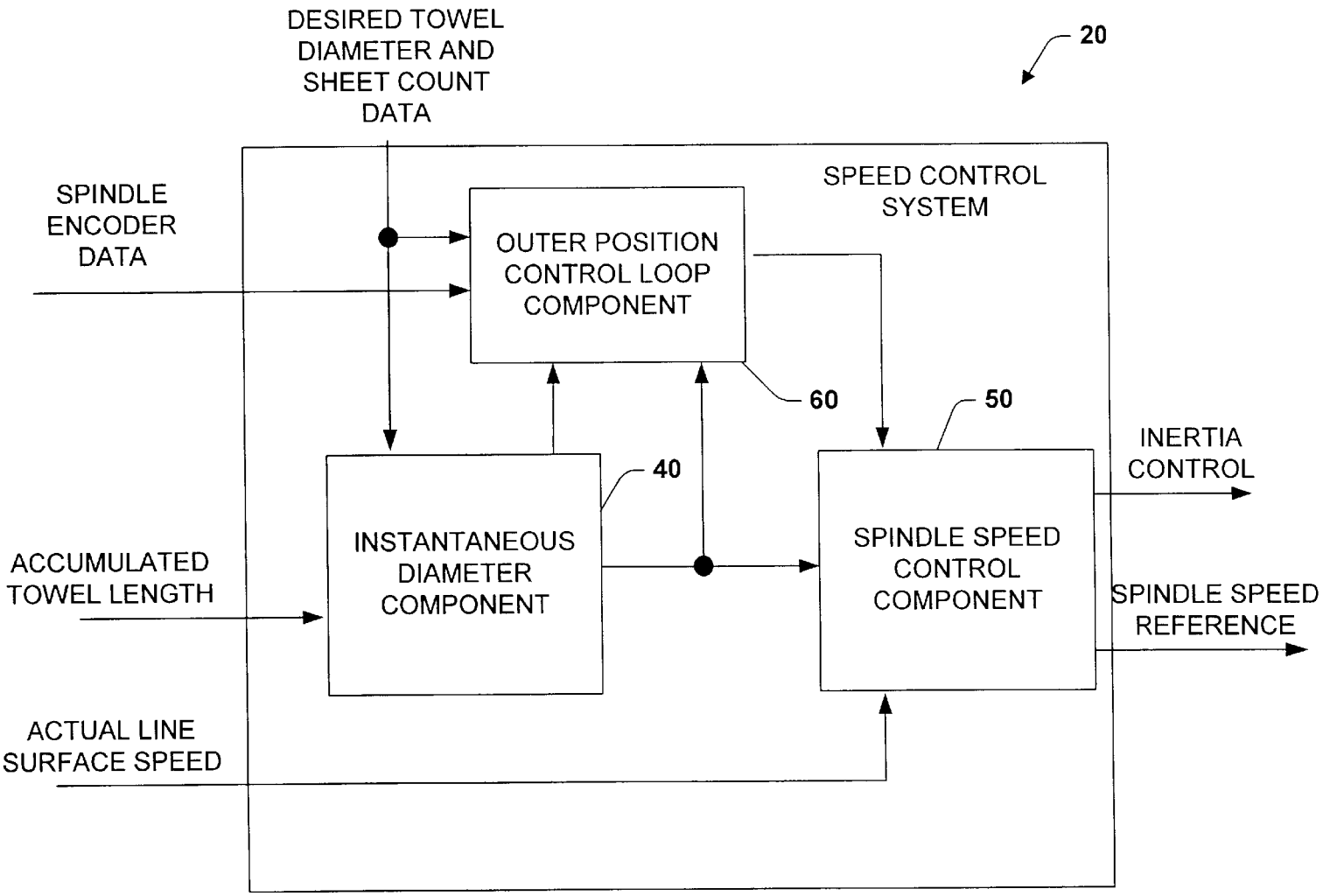
FIG. 2 illustrates a block diagram of the speed control system of FIG. 1 in accordance with one aspect of the present invention.

FIG. 2 illustrates an example of the speed control system 20 that may be employed to carry out the present invention. The speed control system 20 includes an instantaneous diameter component 40 coupled to a spindle speed control component 50. The instantaneous diameter component 40 receives desired towel diameter and sheet count data and monitors accumulated towel length. The instantaneous diameter component 40 uses this information to provide the spindle speed control component 50 with instantaneous diameter information. The spindle speed control component 50 monitors actual line surface speed. The spindle speed control component 50 utilizes the instantaneous diameter information and the actual line surface speed data to produce a feed forward speed reference signal and a derivate of the speed reference signal for inertia compensation of the spindle. In accordance with one aspect of the invention, an outer position control loop component 60 is provided. The outer position control loop component 60 provides a velocity trim control signal to the feed forward spindle speed reference signal. The outer position control loop component 60 receives encoder data, which includes monitoring the spindle encoder signal and receiving spindle pulse/revolution information. The outer position control loop component 60 also receives desired outer towel diameter data from the desired towel diameter and sheet count data, and product total length data and instantaneous diameter data from the instantaneous diameter component 40. The outer position control loop component 60 then provides a trim signal for the spindle speed control component 50 to ensure that the number of revolutions of the spindle is considered in the speed reference signal.

Figure 3:
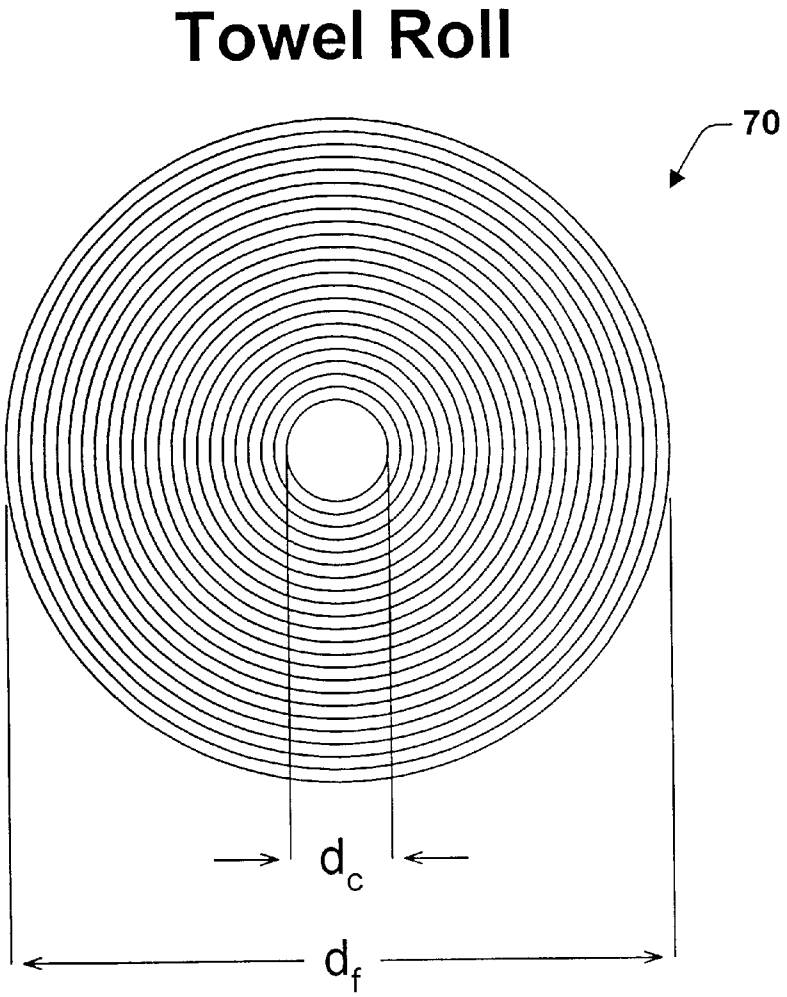
FIG. 3 illustrates a top view of a towel roll in accordance with one aspect of the present invention.
Figure 4:
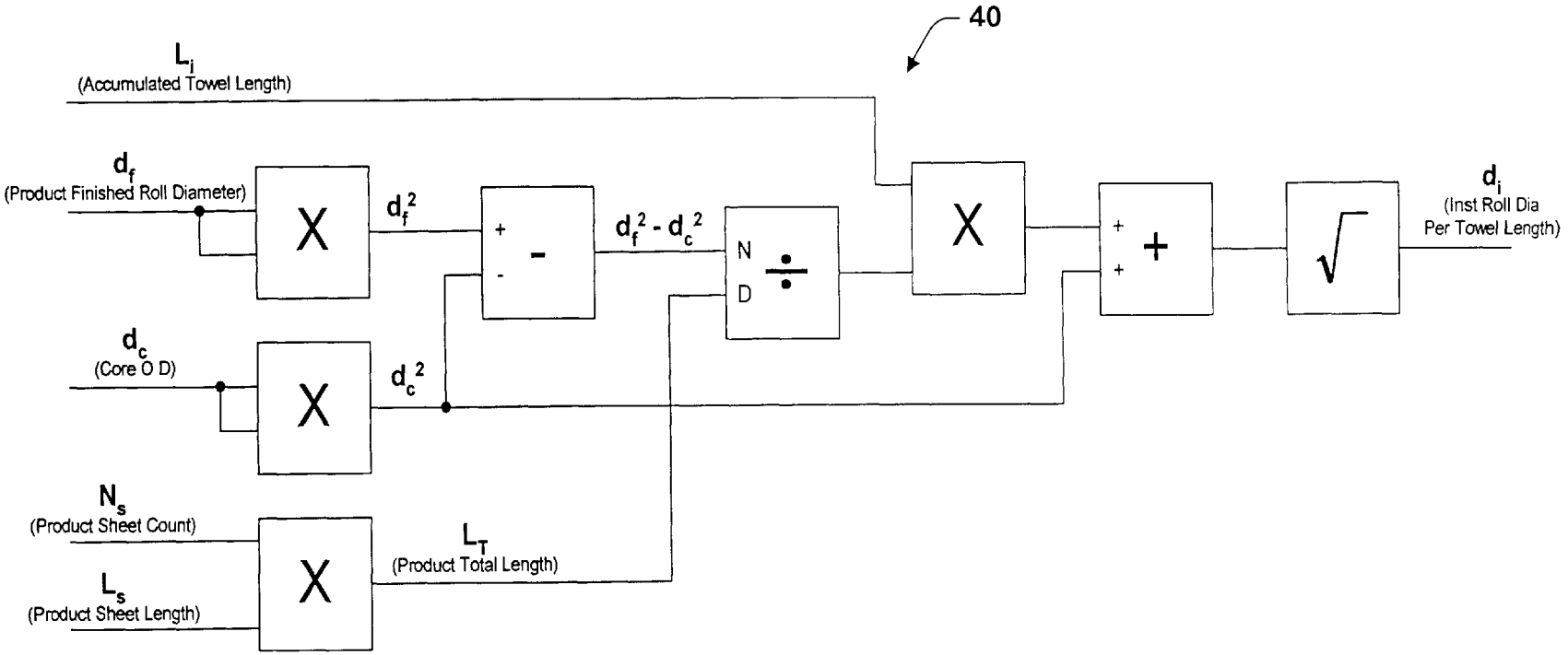
FIG. 4 illustrates a functional block diagram of an instantaneous diameter component in accordance with one aspect of the present invention.

FIGS. 3 and 4 illustrate a methodology for determining an effective thickness of a towel roll. A towel roll 70 having a core thickness $d_c$ and an outer diameter thickness $d_f$ is illustrated in FIG. 3. FIG. 4 illustrates functions performed by the instantaneous diameter component 40 in determining the instantaneous diameter of the roll 70 as it is wound by the towel winder system. The instantaneous diameter component 40 can perform these functions via software, digital or analog hardware or a combination thereof. The methodology employed for providing the functions necessary in determining the instantaneous diameter are based on evaluating the effective thickness of the roll. The effective thickness of the roll includes the thickness of the towel or tissue and the air gaps that may form within the towel or tissue. The effective thickness of the roll can be determined as follows.

The cross-sectional area of a wound towel ($A_\tau$) is equal to the difference of circular areas:

$$A_\tau=\pi/4(d_f^2-d_c^2) \quad \{1\}$$

The area of wound towel ($A_\tau$) is also equal to the total length of towel ($L_\tau$) times the effective thickness ($h_e$):

$$A_\tau=(L_\tau)(h_e) \quad \{2\}$$

Solving for effective thickness ($h_e$) is accomplished by setting both equations equal to each other:

$$(L_\tau)(h_e)=\pi/4(d_f^2-d_c^2) \quad \{3\}$$

$$h_e = \frac{\pi(d_f^2 - d_c^2)}{4(L_T)} \quad \{4\}$$

The effective thickness can be used to determine the instantaneous wound roll diameter ($d_i$) based on accumulated towel length. For example, using the same equations for the area of wound towel at any instantaneous towel length ($L_i$) and related instantaneous wound roll diameter ($d_i$):

$$(L_i)(h_e)=\pi/4(d_i^2-d_c^2) \quad \{5\}$$

Solving for the general, instantaneous wound roll diameter ($d_i$), relative to accumulated towel length ($L_i$) results in the following:

$$d_i=\sqrt{[4(Li)(he)]/(\pi)+dc^2} \quad \{6\}$$

Per equation {4} above, the effective thickness ($h_e$), towel gauge plus entrapped air, for a particular brand is:

$$h_e = \frac{\pi(d_f^2 - d_c^2)}{4(L_T)} \quad \{4\}$$

Substituting for effective thickness ($h_e$) in equation {6}:

$$d_i=\sqrt{[(L_{i)(d_{f2}-d_{c2})}]/(L_{\tau)+d_{c2}}} \quad \{7\}$$

The above relationship is used to determine instantaneous wound roll diameter ($d_i$), for a towel roll with a desired effective wrap thickness ($h_e$), at any given towel length ($L_i$). The instantaneous diameter component 40 can evaluate this relationship utilizing software functions, hardware functions, or a combination of both.

Figure 5:
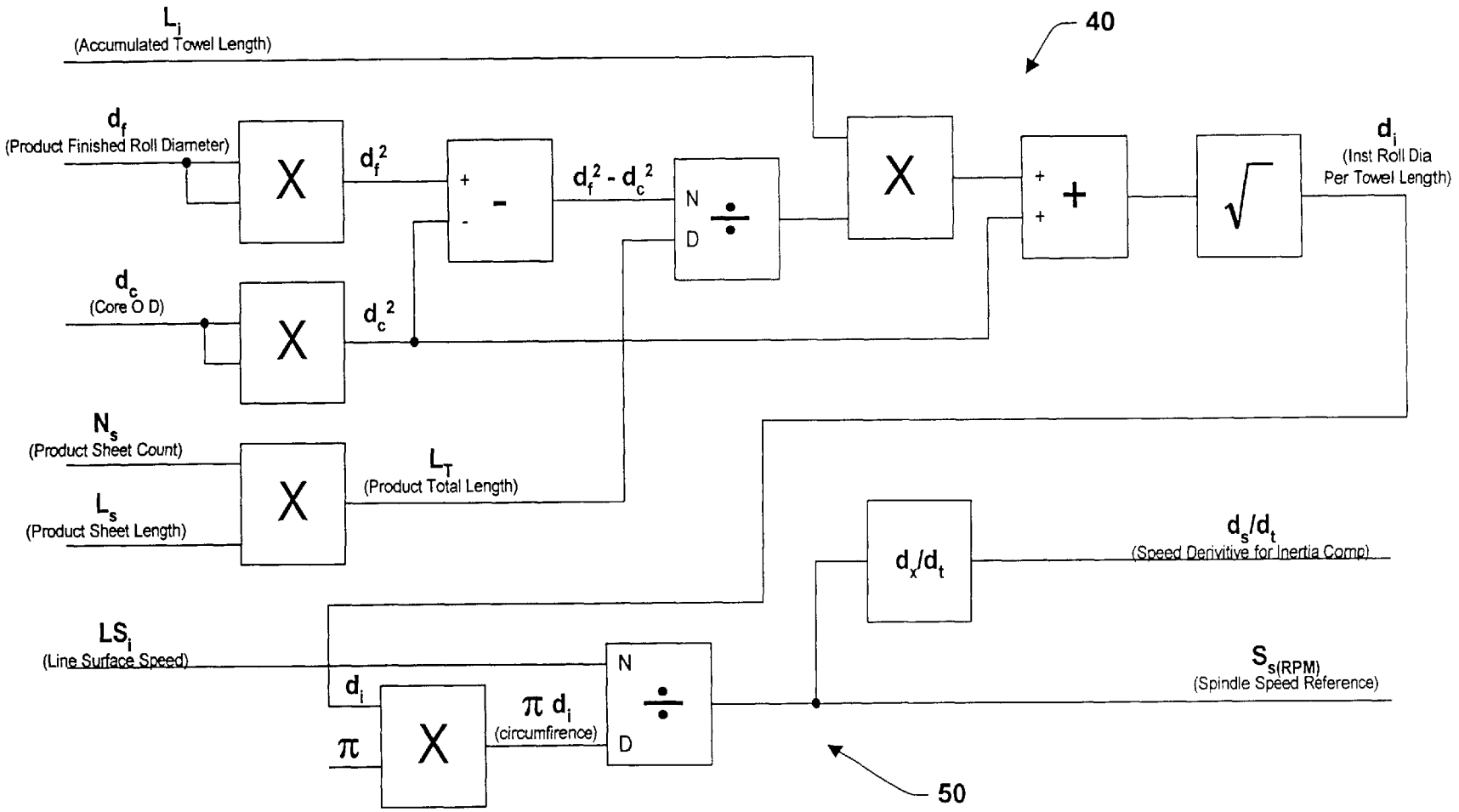
FIG. 5 illustrates a functional block diagram of FIG. 4 including spindle speed control functional blocks in accordance with one aspect of the present invention.

The instantaneous wound diameter can be then transmitted to the spindle speed reference control component 50 for determining the spindle speed forward reference signal. FIG. 5 illustrates functions performed by the instantaneous diameter component 40 and the spindle speed reference control component 50 in determining the spindle speed reference signal. The required spindle speed ($S_s$) in RPM is equal to the known line surface speed ($LS_i$) divided by the roll circumference ($\pi d_i$) and is evaluated as follows:

$$S_{s(RPM)}=(LS_i)/\pi(d_i) \quad \{8\}$$

Figure 6:
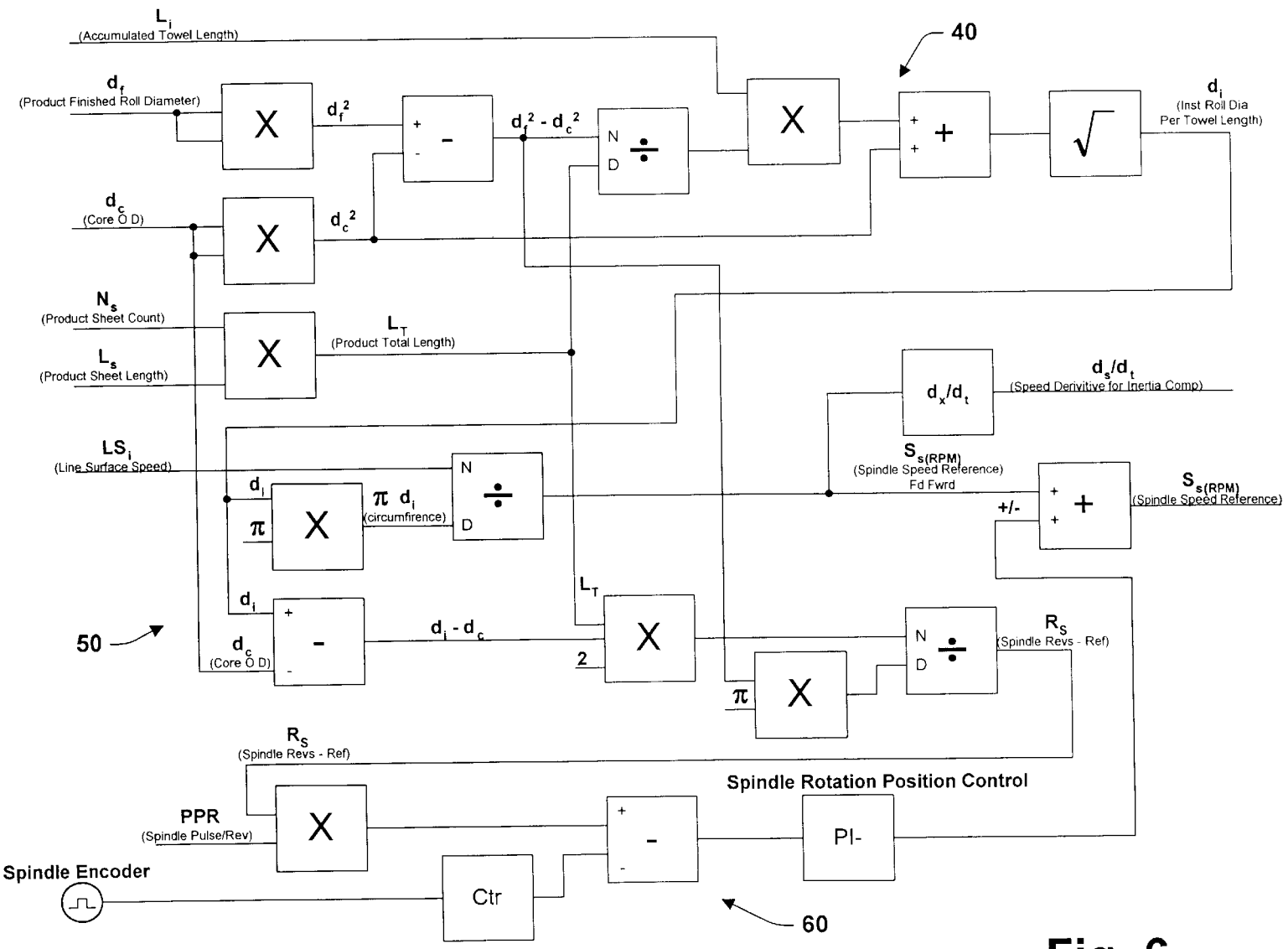
FIG. 6 illustrates a functional block diagram of FIG. 5 including outer position control loop components in accordance with one aspect of the present invention.

The outer position loop component 60 is an alternate component and is implemented to control the amount of revolutions of the spindle to ensure sheet count. FIG. 6 illustrates in block diagram form the functions performed by the instantaneous diameter component 40, the spindle speed reference control component 50 and the outer position control loop component 60 in determining the spindle speed reference signal.

The progressive number of spindle revolutions ($R_s$), or wraps, is a function of the wound roll build-up ($(d_i-d_c)/2$), divided by the effective wrap thickness ($h_e$).

$$R_s=(d_i-d_c)/2(h_e) \quad \{9\}$$

Substituting for effective wrap thickness per equation {4}:

$$h_e = \frac{\pi(d_f^2 - d_c^2)}{4(L_T)} \quad \{4\}$$

Spindle revolutions ($R_s$), as a function of instantaneous diameter ($d_i$) is then evaluated as follows:

$$R_S = \frac{2(L_T)(d_i - d_c)}{\pi(d_f^2 - d_c^2)} \quad \{10\}$$

Incorporating an outer position control loop includes monitoring tracking spindle revolutions (Rs) based on instantaneous diameter ($d_i$), which is based on accumulated towel length ($L_i$). This information is used to provide a velocity trim control to the feed-forward spindle speed reference signal ($S_s$).

Figure 7:
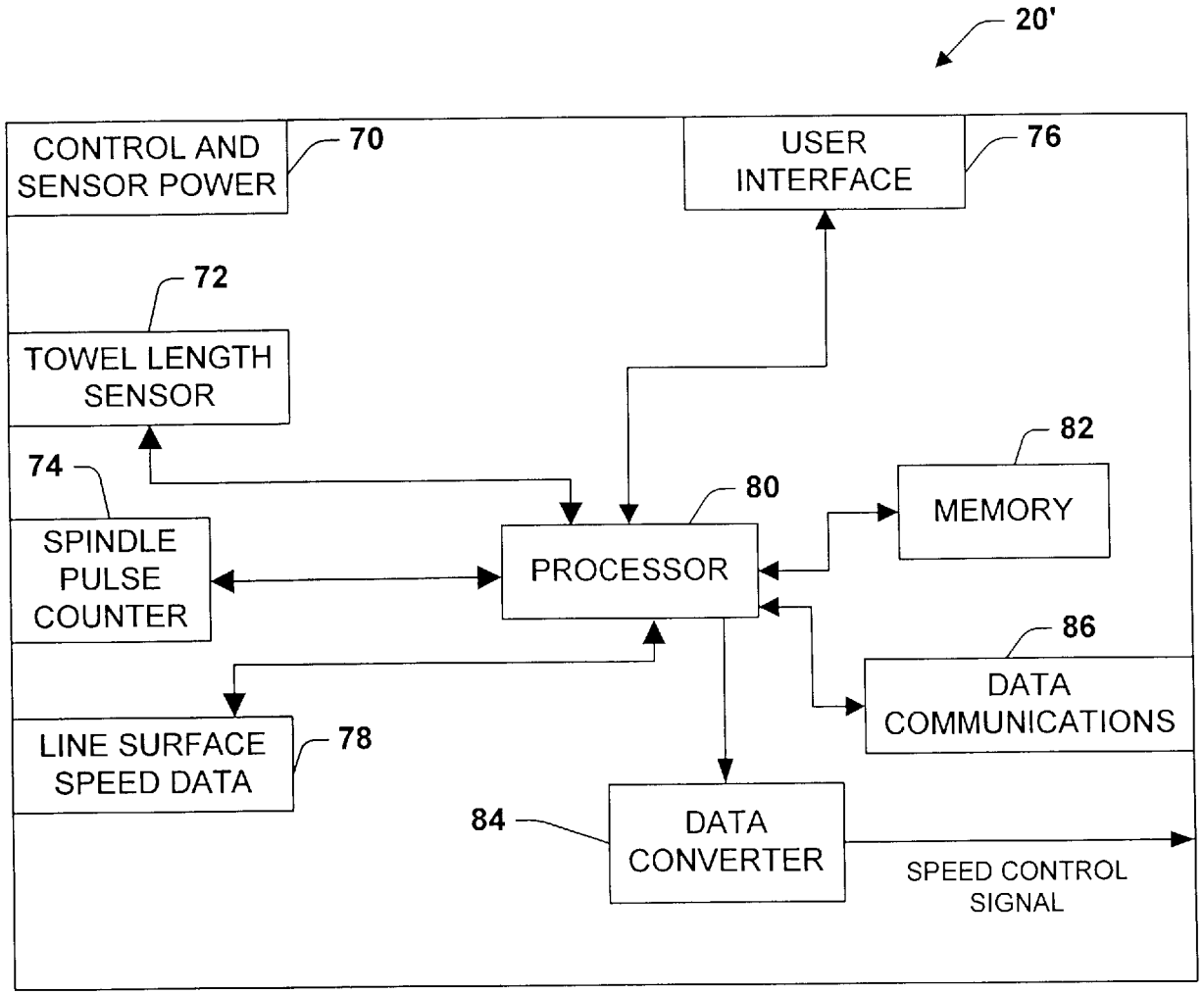
FIG. 7 illustrates a partial schematic diagram of a speed control system in accordance with one aspect of the present invention.

It is to be appreciated that the functions of the instantaneous diameter component 40, the spindle speed reference control component 50 and the outer position control loop component 60 can be implemented by utilizing a processor system and software programmed to operate the processor system. FIG. 7 illustrates a speed reference control system 20' including a processor 80 coupled to a towel or tissue length sensor component 72, a spindle pulse counter 74 and a line surface speed component 78. The towel length sensor component 72 is adapted to measure the towel or tissue length using an incremental encoder or the like and convert the data to digital data for monitoring by the processor 80 and determining accumulated towel length. Alternatively, the towel tissue length sensor component 72 could monitor the rotations of the bed roll supplying paper to the spindle. The line surface speed data component 78 is adapted to measure or receive the line surface speed data and convert the data to digital data for monitoring by the processor 80. The pulse counter 74 counts pulse counts received from the encoder of the spindle and transmits the pulse count to the processor 80 for monitoring. The processor 80 is also coupled to a user interface 76 for inputting data regarding the desired towel diameter and sheet count of a particular production run. The processor 80 monitors the towel length, the line surface speed and the spindle revolutions and receives roll data requirements from the user interface 76 and produces a speed reference control signal based on the monitored and received parameters. The processor transmits the speed reference control signal to a data converter 84. The data received from the processor can be converted to analog, numeric or frequency reference form to a spindle drive system (not shown). A data communications device 86 can be provided for communicating this information to other devices.

The processor 80 is programmed to control and operate the various components within the system 20' in order to carry out the various functions described herein. Power is provided to the processor 80 and other components forming the system 20' from a control and sensor power unit 70. However, it will be appreciated that such power could be obtained from an AC conventional 115 VAC, 60 Hz line utilizing power converting system (not shown). The processor or CPU 80 can be any of a plurality of suitable processors. The manner in which the processor 80 can be programmed to carry out the functions relating to the present invention will be readily apparent to those having ordinary skill in the art based on the description provided herein.

A memory 82 operatively coupled to the processor 80 is also included in the system 20' and serves to store program code executed by the processor 80 for carrying out operating functions of the system 20' as described herein. The memory 82 also serves as a storage medium for temporarily storing information such as desired towel diameter and sheet count, tables and the like. The memory 82 is adapted to store a complete set of the information to be utilized in performing monitoring of the spindle speed, line surface speed and spindle revolutions and output a speed reference control signal. According to one aspect of the invention, the memory 82 has sufficient capacity to store an entire speed profile, and the processor 80 could include a program for comparing between various sets of speed profiles.

Figure 8:
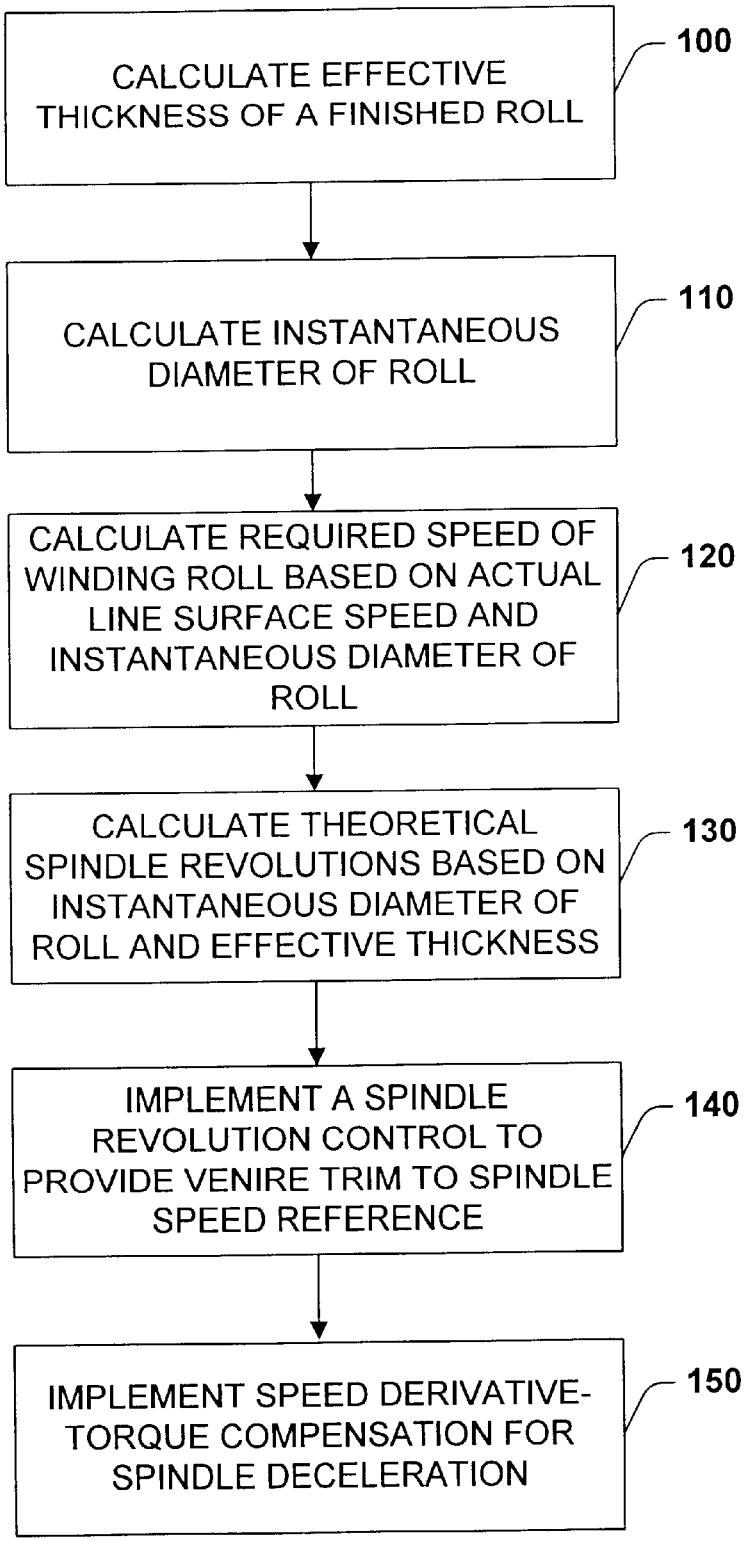
FIG. 8 is a flow diagram illustrating a methodology of generating a speed reference signal in accordance with one aspect of the present invention.

FIG. 8 is a flow diagram illustrating one particular methodology for the processor 80 in determining a speed control reference signal in accordance with the present invention. In step 100, the processor 80 calculates the effective thickness of a finished roll based on the desired roll diameter and sheet count data. In step 110, the processor 80 calculates the instantaneous diameter of the roll using the effective thickness and the actual accumulated towel length metered onto the towel winder. In step 120, the processor 80 calculates the speed of the winding roll based on the actual line surface speed and the instantaneous diameter of the roll. In step 130, the processor 80 calculates the theoretical spindle revolutions based on instantaneous diameter and effective thickness. An optional step of implementing a spindle revolution control to provide venire trim to spindle speed reference is employed in step 140. In step 150, the processor 80 implements a speed derivative torque compensation for spindle deceleration.

The results obtained from the present invention allow for the development of an interactive towel winding spread sheet tool as shown in table I. The towel winding spread sheet can be employed as a tool for providing start-up values and for allowing experimentation with different possibilities. The towel winding spread sheet allows for the modification of the basic product set-up data, such as sheet length in inches ($L_s$) and the core OD in inches ($d_c$). The towel winding spread sheet also allows for the modification of the particular brand product data, such as sheet count, and finished roll diameter in inches ($d_f$). The towel winding data spread sheet can be used as a tool for calculating total length of towel ($L_T$) on the finished roll, and the effective thickness ($h_e$) of the individual wraps. For example, by entering the number of sheets on a roll, from zero (0) to a brand sheet count level (1st column), for any of a selected towel brand, the towel winding data spread sheet can provide the length of towel on roll ($L_i$), the diameter of the roll ($d_i$), and the mandrel revolution count ($R_s$). Furthermore, by entering machine speed in feet per minute (fpm), from zero (0) to 2500 rpm, the towel winding data spread sheet can provide spindle speed in rpm.

TABLE I

| Towel Winding Data | | | | | | | | |
|---|---|---|---|---|---|---|---|---|
| Sht Len-in Ls = 10.6 | | | | Core OD-in dc = 1.5 | | | Machine Spd-FPM LSi = 2500 | |
| Brand | | | | Sheets | | | Spindel | Spindel |
| Sht Cnt | df-in | LT-in | he | On Roll | Li | di | Revs | RPM |
| 50 | 4.85 | 530 | 0.031523 | 50 | 530 | 4.85 | 53.135194 | 1968.9271 |
| 55 | 4.85 | 583 | 0.028658 | 55 | 583 | 4.85 | 58.448713 | 1968.9271 |
| 70 | 4.85 | 742 | 0.022517 | 70 | 742 | 4.85 | 74.389271 | 1968.9271 |
| 75 | 5.15 | 795 | 0.023979 | 75 | 795 | 5.15 | 76.107176 | 1854.2323 |
| 75 | 5.6 | 795 | 0.028758 | 75 | 795 | 5.6 | 71.283482 | 1705.2315 |

The present invention has been illustrated with respect to a particular example of components that can be employed in carrying out the present invention. It is further to be appreciated that any programming methodology and/or hardware architecture suitable for carrying out the present invention may be employed and are intended to fall within the scope of the hereto appended claims.

The invention has been described with reference to preferred examples of the present invention. Obviously, modifications and alterations will occur to others upon reading and understanding the foregone detailed description. It is intended that the invention be construed as including all such modifications, alterations, and equivalents thereof.

What is claimed is:

1. A method of controlling a spindle drive during the winding of a towel roll on a towel winder system, comprising:

monitoring at least one real time parameter relating to the winding of the towel roll;

determining an effective thickness of the towel roll;

determining an instantaneous diameter parameter of the roll based on the effective thickness and the at least one real time parameter; and determining a speed spindle component that adjusts the speed of the spindle drive based on changes in the instantaneous diameter parameter.

2. The method of claim 1, the at least one real time parameter being an accumulated towel length parameter on the towel roll.

3. The method of claim 1, the speed spindle component also being based on a line surface speed parameter.

4. The method of claim 3, the spindle speed component being determined by dividing the line surface speed by the circumference of the roll using the instantaneous diameter parameter.

5. The method of claim 1, further including the step of determining an inertia control component by evaluating the derivative of the spindle speed component.

6. The method of claim 1, further comprising determining a velocity trim control component for the spindle speed component.

7. The method of claim 6, the step of determining a velocity trim control component adapted to trim the spindle speed component to control the revolutions of the spindle.

8. The method of claim 7, further comprising using the instantaneous diameter component and actual spindle revolutions in providing a velocity trim control component.

9. A method of developing a speed profile for a spindle drive during the winding of a towel roll on a towel winder system, comprising the steps of:

evaluating an effective thickness of the towel roll;

monitoring an accumulated towel length during winding of the towel roll;

determining an instantaneous diameter parameter of the towel roll based on the effective thickness of the roll and the accumulated towel length; and determining a speed spindle component that adjusts speed of the spindle drive based on changes in the instantaneous diameter.

10. The method of claim 9, the step of determining a speed spindle component further including the step of monitoring a line surface speed parameter.

11. The method of claim 10, the spindle speed component being determined by dividing the line surface speed parameter by the circumference of the roll using the instantaneous diameter parameter.

12. The method of claim 9, further including the step of determining an inertia control component by evaluating the derivative of the spindle speed reference component.

13. The method of claim 9, further including the step of determining a velocity trim control component for the spindle speed reference component.

14. The method of claim 13, the velocity trim control component being adapted to trim the spindle speed reference component to control the revolutions of the spindle.

15. The method of claim 13, further including the step of monitoring actual spindle revolutions in providing a velocity trim control component.

16. A system for controlling a spindle drive during the winding of a towel roll on a towel winder system comprising:

an instantaneous diameter component adapted to monitor accumulated towel length and generate an instantaneous diameter value based on an effective thickness of the towel roll and the accumulated towel length; and a spindle speed reference component adapted to receive an instantaneous diameter value from the instantaneous diameter component and generate a spindle speed reference value.

17. The system of claim 16, the instantaneous diameter component further adapted to receive desired towel diameter and sheet count data.

18. The system of claim 16, the spindle speed component further adapted to monitor actual line surface speed and using actual line surface speed data in generating the spindle speed reference value.

19. The system of claim 16, the spindle speed reference component further adapted to generate an inertia control value.

20. The system of claim 16, further including an outer position control loop component adapted to trim the spindle speed reference control component for controlling the revolutions of the spindle.

21. The system of claim 16, the outer position control loop component being coupled to the instantaneous diameter component and being adapted to receive desired towel diameter and sheet count data.

22. A system for controlling a spindle drive during the winding of a towel roll on a towel winder system comprising:

a processor;

a memory operatively coupled to the processor; and at least one sensor operatively coupled to the processor, the at least one sensor being adapted to monitor a real time parameter relating to the winding of the towel roll;

wherein the processor receives digital data relating to the real time parameter and generates a spindle speed reference value based on an effective thickness of the towel roll and the at least one real time parameter.

23. The system of claim 22, the real time parameter relating to accumulated towel length.

24. The system of claim 22, the real time parameter relating to actual line surface speed.

25. The system of claim 22, the at least one sensor including a sensor for measuring a first parameter relating to accumulated towel length and a second sensor relating to actual line surface speed.

26. The system of claim 25, the at least one sensor further including a sensor for measuring a third parameter relating to spindle revolutions.

27. The system of claim 22, further including a user interface coupled to the processor, the user interface being adapted to receive desired towel diameter and sheet count data.

28. A system for controlling a spindle drive during the winding of a towel roll on a towel winder system comprising:

means for monitoring at least one real time parameter relating to the winding of the towel roll;

means for determining an instantaneous diameter value based on an effective thickness of the towel roll; and means for determining a spindle speed reference component for adjusting the speed of the spindle drive based on the at least one real time parameter and the instantaneous diameter value.

29. The system of claim 28, further including means for controlling the revolutions of the spindle.

30. The system of claim 28, further including means for providing an inertia control component.

31. The system of claim 28, further including means for providing start-up values.

* * * * *